United States Patent [19]

Gibello

[11] 4,078,796

[45] Mar. 14, 1978

[54] INSERT DEVICE FOR APPLICATION TO THE INTERSECTIONS OF TENNIS RACKET STRINGS

[75] Inventor: Carlo Gibello, Turin, Italy

[73] Assignees: Selcom-Camsa s.a.s. di Carlo Gibello & C.; Fabra s.r.l., both of Turin, Italy

[21] Appl. No.: 738,266

[22] Filed: Nov. 2, 1976

[30] Foreign Application Priority Data

Dec. 4, 1975 Italy ..... 69986/75
May 26, 1976 Italy ..... 68296/76

[51] Int. Cl.[2] ..... A63B 51/00
[52] U.S. Cl. ..... 273/73 D
[58] Field of Search ..... 273/73 R, 73 D; 124/90, 124/41 A

[56] References Cited

U.S. PATENT DOCUMENTS 1,682,199 8/1928 Smilie ..... 273/73 D
3,733,243 5/1973 Crawford ..... 273/73 DX
3,921,979 11/1975 Dischinger ..... 273/73 D X

FOREIGN PATENT DOCUMENTS 24,856 of 1913 United Kingdom ..... 273/73 D

*Primary Examiner*—Richard J. Apley
*Attorney, Agent, or Firm*—Sughrue, Rothwell, Mion, Zinn and Macpeak

[57] ABSTRACT

An insert device for application to the intersections of tennis racket strings comprises a body of substantially rigid material adapted to be interposed between two intersecting strings. The body has a pair of mutually perpendicular grooves, each groove being adapted to accommodate a portion of a respective racket string and having a depth such that the portion of string accommodated in the groove does not protrude beyond the adjoining said surface of the body. The walls of each groove are formed with ribs or protuberances for the purpose of gripping a said portion of a racket string accommodated therein.

6 Claims, 6 Drawing Figures

INSERT DEVICE FOR APPLICATION TO THE INTERSECTIONS OF TENNIS RACKET STRINGS

The present invention relates to insert devices for application to the intersections of tennis racket strings.

The invention relates particularly to insert devices of the kind comprising a body of substantially rigid material adapted to be interposed between two intersecting strings in their zone of intersection, the body having a pair of mutually perpendicular grooves in opposite surfaces, each groove being adapted to accommodate a portion of a respective racket string and having a depth such that the portion of string accommodated in the groove does not protrude beyond the adjoning said surface of the body.

Many types of insert devices of the aforesaid kind have been proposed, all adapted to be applied to each of the intersection points of the strings in the central area of a tennis racket stringing. Such insert devices served the following three purposes:

to protect the strings against wear due to friction of one string against another;

to protect the strings against wear due to contact with the ball;

to increase the spin imparted to the ball in "slicing" or "chopping" strokes and "damping" strokes, usually referred to as "drop shots".

One such insert device is described and illustrated in German Patent Application DT-OS 2,258,872 and in the corresponding French Patent Application 73.42881. This device is made of plastics material with a low coefficient of friction with respect to the racket strings and is self-lubricating so as to allow the strings to slide in the grooves in the device. Such devices have the following disadvantages:

during play the ball inevitably deposits on the strings of the racket abrasive particles of grit or earth. These particles are dragged by the strings into the grooves of the insert devices, resulting in wear on the strings which is often greater than that which occurs in a racket which is not fitted with insert devices;

when making "chopping" strokes or drop shots a yielding of the insert devices takes place and those parts of the insert devices which protrude with respect to the strings come into contact with the ball. This results in these devices sliding to a certain extent along the strings on which they are fitted, so that it is not possible to impart to the ball tangential forces much greater than those which could be imparted by means of a normal racket not fitted with insert devices. Such sliding results in lateral displacement and irregular stretching of the strings, with a consequent yielding or reduction of the original string tension.

Earlier racket insert devices had been proposed for the purpose of protecting the strings against wear and increasing the spin effects which can be imparted to the ball.

For example, French Patent Specification No. 462,767, and the corresponding U.K. Patent Specification No. 24.856 A.D. 1913 and Austrian Patent Specification No. 82.519, describe racket insert devices in the form of leather studs provided with grooves of a depth equal to the diameter of the strings. In order to counteract the tendency for the strings to slide in the grooves the high coefficient of friction between the leather studs and the strings is exploited.

Likewise, U.S. Pat. No. 1,682,199 describes insert devices comprising rings made of a material with a very high coefficient of friction, such as rubber, which when interposed between two crossed strings of a racket are deformed with a bi-concave shape defining two crossed grooves in which the racket strings are accommodated. In the same specification reference is also made to the use of aluminium elements having the aforementioned bi-concave form, the grooves of which have a wedge-shaped transverse section in order to ensure a grip on the strings.

The devices described in French Patent Specification No. 462,767 and U.S. Pat. No. 1,682,199 are not, however, able to hold the strings firmly in position, since the walls of the grooves in these devices, being smooth, do not exert a sufficient frictional grip on the strings, even when these are wedged in the grooves, to counteract the forces which interact between a ball and a racket in play.

French Patent Specification No. 698,267 describes the connection of the strings together by means of an adhesive and the subsequent interposition of insert devices which in one embodiment are formed by semitubular elements. This solution, as far as is known, has not met with any success, because it is very difficult for an adhesive to resist, over a long period of time, the forces arising in play and it very quickly loses both its protective characteristics, because of wear, and its adhesion to the strings.

The object of the present invention is to provide an insert device which is capable of holding the intersecting strings of a tennis racket firmly together in their intersection zones with a view to increasing the spin effects imparted to the ball in "slicing" strokes or drop shots, while also protecting the strings against wear.

According to the present invention there is provided an insert device of the kind previously referred to characterised in that each groove of the insert device body is formed with ribs or protuberances projecting into the respective groove.

The insert devices according to the invention can achieve a positive mechanical interconnection of the strings due to the pressing of the ribs or protuberances provided in the grooves into the strings under the action of the force components, resulting from the tension in the strings themselves, which are exerted perpendicularly to the plane of the racket stringing, tending to press the strings onto the bottoms of the grooves. In this way relative sliding between the strings is prevented and both the insert devices and the strings remain in their correct positions.

By interposing insert devices according to the invention at all the string intersections in a wide central impact area of the racket stringing, while leaving the peripheral area of the stringing devoid of such devices, all the strings of the central area participate in an impact with a ball, and not just those which are directly involved in the stroke in question, and consequently the efficiency -f a stroke, even if it is not centralised, remains substantially the same over all the central area of the racket stringing.

On the other hand, the elastic behaviour of the stringing in the peripheral area devoid of insert devices is not substantially influenced by the interconnection of the strings in the central area, because the devices are not applied during the racket stringing process, but after the stringing has been completed. In this case, all the peripheral area of the racket preserves its original tension and elasticity.

The behaviour of racket stringing provided with the insert device according to the invention is comparable to that of a sprung trampoline sheet used in gymnastics: in the central zone the strings are firmly interconnected and behave like the trampoline sheet, whereas the strings in the peripheral zone, devoid of insert devices, are free and behave like the elastic suspension ties of the sheet.

The invention will now be further described, by way of non-limiting example, with reference to the accompanying drawings, in which.

Figure 1:
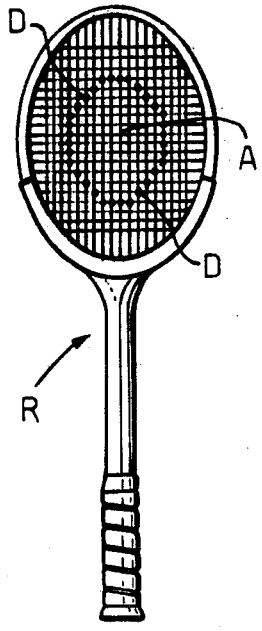
FIG. 1 is a front elevational view of a tennis racket the central impact area of which is fitted with insert devices according to the invention.

Referring to FIG. 1, a tennis racket R is provided, in its entire central impact area A, with an insert device D according to the invention at each of the intersections of the longitudinal and transverse strings. For the sake of simplicity, only the insert devices D which define the boundary of the central impact area A are indicated (by dots). The most advantageous shape for the central impact area A thus defined is an octagon, as shown.

Figure 2:
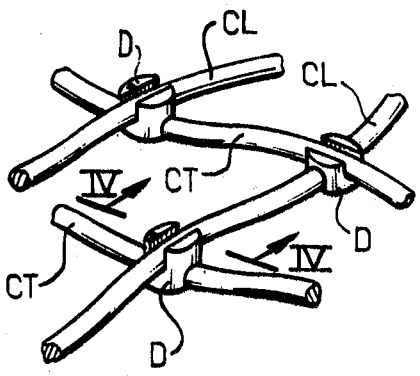
FIG. 2 is a perspective view on an enlarged scale of some of the intersecting strings in the impact area of the racket, fitted with insert devices according to a preferred embodiment of the invention.
Figure 3:
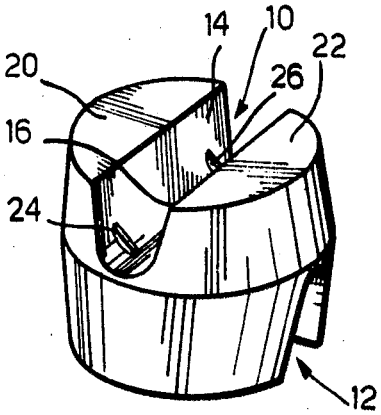
FIG. 3 is a perspective view of one of the insert devices illustrated in FIG. 2, on an even larger scale.
Figure 4:
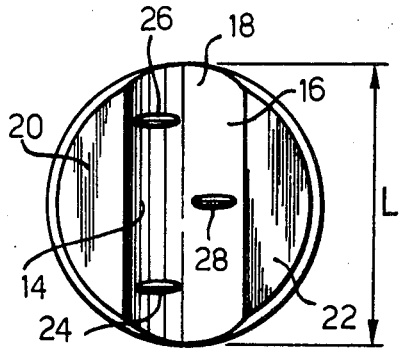
FIG. 4 is a plan view of the insert device.

FIG. 2 shows three insert devices D according to the invention applied to respective intersections between longitudinal strings $C_L$ and transverse strings $C_T$.

With reference to FIGS. 3 to 6, as well as to FIG. 2, each insert device D consists of a body of any suitable rigid or semi-rigid material, preferably a plastics material such as acetal or polyamide resin, or a metal. The body has a slightly barrel-shaped generally cylindrical form. The hardness of the material forming the body will be chosen according to the preferences of the player.

Figure 5:
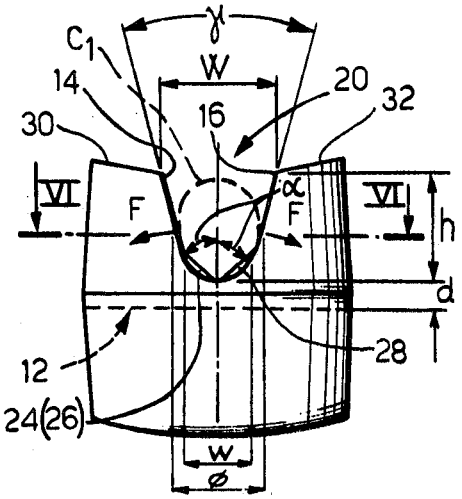
FIG. 5 is a lateral view of the insert device, showing in cross section one string inserted in one of the grooves of the device.
Figure 6:
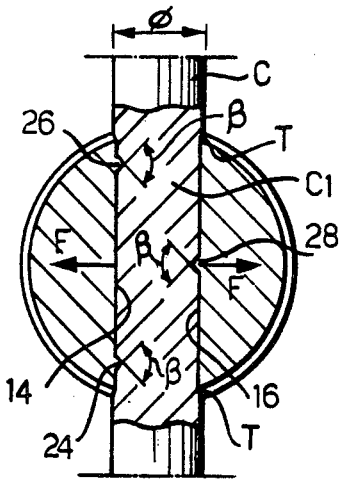
FIG. 6 is a cross section taken along the line VI—VI of FIG. 5.

In the opposite end faces of the said body there are two opposed grooves 10 and 12 extending in mutually perpendicular directions, each groove being adapted to accommodate a portion $C_1$ of a respective string C, as shown in the FIGS. 5 and 6, the two grooves 10 and 12 in use of the device accommodating longitudinal and transverse strings $C_L$ and $C_T$ respectively (FIG. 2).

Apart from the fact that they are mutually perpendicular, the grooves 10 and 12 are identical and each has two smooth symmetrical side walls 14 and 16 which preferably, as shown, converge towards a curved bottom 18 of the groove. The bottom 18 has the profile in cross section of an arc of a circle smoothly adjoining the two side walls.

Each of the two end faces of the said body of the insert device D is divided by the respective groove into a symmetrical pair of segment-shaped faces 20, 22 sloping towards the respective groove and forming between each other a very wide dihedral angle, for example, 150°. This slope of the two faces 20 and 22 forms a lead-in which assists the insertion into the respective groove of a string located on one of the faces 20, 22.

According to the invention transverse protuberances or ribs 24, 26 and 28 are formed in each groove 10 and 12, each rib preferably having a triangular cross section. The arrangement illustrated in the drawings is the preferred one, in which two of the ribs 24 and 26 are situated adjacent the opposite ends of the groove and to one side of its median longitudinal plane and the third rib 28 is situated in the central transverse plane of the groove and to the other side of its median longitudinal plane.

The free edge of each triangular-section rib 24, 26, 28 extends in a transverse plane of the groove and, starting from the bottom 18 of the groove, is inclined upwardly (in the position of the insert device shown in FIG. 3) merging into one of the two side walls 14 or 16.

As will be readily understood, the ribs 24, 26, 28 assist in firmly gripping the portion $C_1$ of a racket string C inserted therein. Each rib 24, 26, 28 is pressed into the said inserted portion of the string, preventing relative sliding between string and insert device and, therefore, preventing departure of the strings from their correct positions.

The aforementioned gripping of the inserted portion of the string is assisted by the converging side walls 14 and 16 which guide the inserted portion $C_1$ (FIGS. 5 and 6) into a centered position at the bottom 18 of the groove. In this manner the inserted portion $C_1$ is brought into firm engagement with the ribs 24, 26, 28, and in addition a small deformation of the string occurs, due to the wedging of the string portion $C_1$ between the side walls 14 and 16. The deformed condition due to the wedging of the inserted portion $C_1$ of the string in the respective groove 10 is clearly visible in FIG. 5 and particularly in FIG. 6 which shows how the ribs 24, 26 and 28 are pressed in the manner of teeth into the natural or synthetic material of the string.

It has been found that although the ribs 24, 26 and 28 are pressed into the inserted portion of the string, the latter is certainly not damaged, due to the fact that the string cannot slide in the respective groove.

Optimum results with regard to the gripping of the strings in the grooves of the insert devices have been obtained with ribs the free edges of which extend from the bottom 18 towards the side walls 14, 16 of the groove at an angle $\alpha$ of the order of 45° with respect to the median longitudinal plane of symmetry of the groove (FIG. 5). The dihedral angle $\beta$ (FIG. 6) of each triangular section rib, that is, the apex angle of the rib in cross section, was of the order of 60°, each rib having a cross sectional shape in the form of an equilateral triangle.

In this example the angle $\gamma$ (FIG. 5) between the two side walls 14 and 16 of the groove was of the order of 30°. The width W of the mouth of the groove was 1.5 mm, that is to say, larger than the normal diameter $\phi$ of a racket string of gauge 9, which is approximately 1.4 mm. The depth $h$ (FIG. 5) of the groove was 1.7 mm. and radius $r$ of the groove bottom 18 was 0.4 mm., which is equivalent to a groove width of 0.9 mm at the junction between the side walls 14 and 16 and the bottom 18 of the groove.

The insert devices D according to the invention have a preferred diametral dimension or length of groove L (FIG. 4) of approximately 3 to 4 mm.

The material forming the insert devices D ans the distance $d$ between the bottoms of their two grooves 10 and 12 can vary according to the use for which the racket is intended. For stringings intended for fast or attack play, it is convenient to use insert devices D of a relatively hard material, such as acetal resins, whilst for stringings which are intended for normal or defense play it is, on the other hand, convenient to use insert devices of relatively soft material, such as polyamide resins. Thus, insert devices D which have different coefficients of elasticity (in shear, torsion etc.) give a greater or less contribution to returning the ball by storing and releasing more or less elastic energy in addition to that which is stored and released by the racket stringing and frame.

Different distances *d* between the bottoms of the crossed grooves give rise to greater or lesser locking forces which can be used to obtain a corresponding variation of tension of the stringing in the area where the strings are locked by the insert devices. Said distances between the bottoms can vary from about 0 to 4 mm.

A normal racket with a natural gut stringing and provided with insert devices of polyamide resin was subjected to a string durability test in a laboratory using a suitably constructed test rig in which the handle of the racket was fixed to a mechanical arm which allows the racket head or stringing to strike a ball at various angles of incidence with an average pressure of 40 kg/cm$^2$ and with a frequency of 24 strokes per minute.

After a continuous test of a duration of 8 hours 27 minutes the insert devices appeared to be worn out, but no breaking of the strings occurred.

The same test was carried out with a racket provided with strings identical to those of the preceding test, but without insert devices. The stringing showed evidence of sagging towards the end of the first hour of the test and the first string ruptures occurred 1 hour 12 minutes after the start of the test.

On another suitably constructed test rig, using different types of rackets and stringings and under the same conditions, comparative serve tests and directional-control tests were effected as well as tangential impact tests (ball spin tests).

In the serve and directional control tests on rackets without insert devices the points of arrival of the ball on the ground were distributed within a circle of approximately 236 cm, the centre of which was at approximately 13.6 m from the point of serve of the ball and was displaced by about 1.5° to the left with respect to the axis of serve. In the same tests on rackets with insert devices, the points of arrival of the ball were distributed with in a circle of only 62 cm diameter, the centre of which was at about 14.7 m from the point of serve and was displaced by about 0.3° to the right of the axis of serve.

In the tangential impact tests, effected by imparting to the ball a right hand spin effect, the points of arrival of the ball on the ground, using a racket without insert devices, were distributed over a circle of 225 cm diameter, the centre of which was located at approximately 12.4 m from the point of serve of the ball, and were displaced by about 2.5° to the right of the axis of serve, whereas using a racket with insert devices according to the invention, the points of arrival of the ball were distributed over a circle of only 60 cm diameter, the centre of which was located at approximately 13.6 m from the point of serve of the ball and was displaced by about 6.4° to the right with respect to the axis of serve.

What is claimed is:

1. An insert device for application to the intersections of tennis racket strings, of the kind comprising a body of substantially rigid material adapted to be interposed between two intersecting strings in their zone of intersection, the body having opposite surfaces formed with a pair of mutually perpendicular grooves, each groove being adapted to accommodate a portion of a respective said string and having a depth such that the portion of the string accommodated in the groove does not protrude beyond the adjoining said surface of the body, wherein the improvement consists in each groove of the insert device body having two side walls formed with ribs projecting into the respective groove for the purpose of gripping said portion of a string accommodated therein, each rib has a triangular cross section with its free edge extending in a transverse plane within the groove from the bottom of the groove to a point in one of the two side walls of the groove.

2. An insert device as defined in claim 1, wherein two ribs are provided in one side wall of each groove, each situated adjacent one of the ends of the groove, and on one side of its median longitudinal plane, and a third rib is provided in the other side wall of the groove, situated in the central transverse plane of the groove and on the other side of the said median longitudinal plane.

3. An insert device as defined in claim 1, wherein the free edge of each rib is inclined to the median longitudinal plane of the groove at an angle of the order of 45°.

4. An insert device as defined in claim 1, wherein each rib has a cross-sectional shape in the form of an equilateral triangle.

5. An insert device as defined in claim 1, wherein each groove has two smooth symmetrical said side walls converging towards the bottom of the groove, the width of the groove being slightly larger at the mouth of the groove than the normal diameter of a tennis racket string and said width converging towards the bottom of the groove so as to cause a wedging of said inserted portion of a string in the groove.

6. An insert device as defined in claim 5, wherein two side walls of each groove are inclined to each other at a dihedral angle of the order of 30°.

* * * * *